United States Patent [19]

Stephan

[11] Patent Number: 4,949,496

[45] Date of Patent: Aug. 21, 1990

[54] GUN BRUSH

[76] Inventor: Gerard A. Stephan, 11 Oak Pl., Seldon, N.Y. 11784

[21] Appl. No.: 417,481

[22] Filed: Oct. 5, 1989

[51] Int. Cl.[5] ..... F41A 29/02

[52] U.S. Cl. ..... 42/90; 15/104.16; 15/185

[58] Field of Search ..... 42/90, 95; 15/104.16, 15/160, 164, 185

[56] References Cited

U.S. PATENT DOCUMENTS 1,770,344 7/1930 Schmidt ..... 15/185

2,744,275 5/1956 Geltner ..... 15/185

4,509,223 4/1985 Sipple et al. ..... 15/160

*Primary Examiner*—Stephen C. Bentley

*Attorney, Agent, or Firm*—Michael I. Kroll

[57] ABSTRACT

A brush for cleaning a clip receptacle of a gun is disclosed. The gun brush has a handle portion and a brush portion which is attached to the handle portion. The brush portion has a cross sectional shape that matches the cross sectional shape of the clip receptacle of the gun so that the brush portion can easily enter the clip receptacle of the gun and readily clean the clip receptacle.

5 Claims, 1 Drawing Sheet

14
24
16
12
2A
2A
10
22
18
20
14'
12'
10'
16'
34'
18'
32'

16, 16'
22, 22'
24, 24'

32'
20'
26'
10'
18'
34'

16
16'
28'
30'
16'
10
20
36'

18
14
12
24
22
16
10
20
18

GUN BRUSH

BACKGROUND OF THE INVENTION

1. Field of the Invention:

The present invention relates to a gun brush.

More particularly, the present invention relates to a gun brush for cleaning the clip receptacle of the gun.

2. Description of the Prior Art:

Numerous innovations for brushes for cleaning a clip receptacle of a gun have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide a gun brush.

More particularly, it is an object of the present invention to provide a gun brush for cleaning the clip receptacle of a gun.

In keeping with these objects, and with others which will become apparent hereinafter, one feature of the present invention resides, briefly stated, in a brush for cleaning a clip receptacle of a gun and includes a handle portion wherein a brush portion is attached to the handle portion and having a cross sectional shape that matches the cross sectional shape of the clip receptacle of the gun.

When the gun brush is designed in accordance with the present invention, the brush portion can easily enter the clip receptacle of the gun and readily clean the clip receptacle.

In accordance with another feature of the present invention, the cross sectional shape of the brush has a rounded front and a flat back.

Another feature of the present invention is that the brush portion is attached to and in alignment with the handle portion.

Yet another feature of the present invention is that the handle portion contains hand grips so that the user can achieve a better grip.

Still another feature of the present invention is that the brush portion is fixedly attached to the handle portion.

Yet still another feature of the present invention is that the brush portion is pivotally attached to the handle portion so that the brush portion can stay retracted in the handle during the retracted position and can pivot outward during the extended position.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

LIST OF REFERENCE NUMERALS UTILIZED IN THE DRAWING

Figures 1, 2, 2A, 3, 3A, 4:
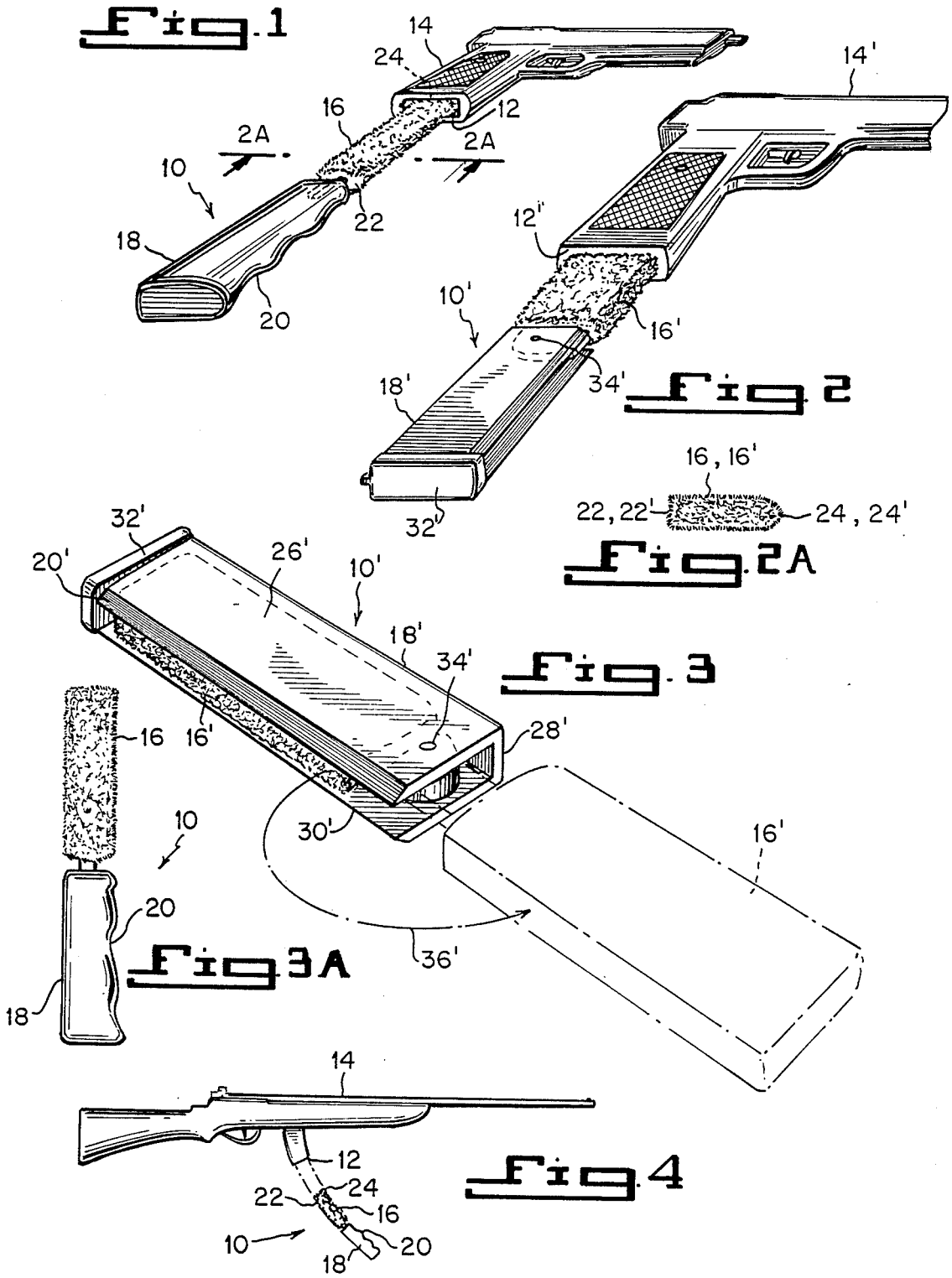
FIG. 1 is a perspective view of a hand gun being cleaned with a fixed brush of the present invention.
FIG. 2 is a perspective view of a hand gun being cleaned with a folded brush of the present invention.
FIG. 2A is a cross-sectional view of the brush of the present invention taken along line 2A—2A in FIG. 1.
FIG. 3 is a perspective view of the folded brush of FIG. 2, in the closed position with phantom lines indicating the open position.
FIG. 3A is a side view of the fixed brush of the present invention, as shown in FIG. 1.
FIG. 4 is a side view of the fixed brush shown cleaning a rifle.

10—a fixed brush version of the present invention
12—a clip receptacle of a gun 14
14—a gun being cleaned by the fixed brush version 10
16—a brush portion of the fixed brush version 10
18—a handle portion of the fixed brush version 10
20—a handle grip on the handle 18
22—a flat back of the brush portion 16
24—a rounded front of the brush portion 16
10'—a folded brush version of the present invention
12'—a clip receptacle of a gun 14'
14'—a gun being cleaned by the fixed brush version 10'
16'—a brush portion of the fixed brush version 10'
18'—a handle portion of the fixed brush version 10'
20'—a handle grip on the handle 18'
22'—a flat back of the brush portion 16'
24'—a rounded front of the brush portion 16'
26'—a side of the handle portion 18'
28'—another side of the handle portion 18'
30'—another side of the handle portion 18'
32'—closed bottom of the handle portion 18'
34'—a pivot point at which the brush portion 16' is rotated about when its position is changed
36'—an arrow indicating the direction traveled when the brush 16' is extended out of the handle 18

DETAILED DESCRIPTION OF THE PREFERRED EMBODIMENT

Referring now to FIGS. 1 and 3A, the fixed brush version of the present invention is shown generally at 10, in use cleaning a clip receptacle 12 of a gun 14.

The fixed brush version 10 contains a brush portion 16 and a handle portion 18. The handle portion 18 contains hand grips 20 which allows the user to achieve a better grip when using the fixed brush version 10.

The cross section of the brush portion 16 can plainly be seen in FIG. 2A. The brush portion 16, includes a flat back 22 and a rounded head 24.

The cross sectional configuration of the brush portion 16 is specific, that is, the clip receptacle 12 located in the gun 14 has a cross section that matches that of the brush 16 so that the brush portion 16 can easily enter the clip receptacle 12 and readily clean the clip receptacle 12.

Referring now to FIGS. 2, 2A, and 3, the folded brush version of the present invention is shown generally at 10' in use cleaning a clip receptacle 12' of a gun 14'.

The handle portion 18' contains three sides 26', 28', and 30', and a closed bottom 32'.

As can be seen in FIG. 3, the brush 16' is tucked away within the handle 18'. The brush 16' is pivotally connected to the handle 18' at a pivot point 34'. The arrow 36' indicates the direction traveled when the brush 16' is extended from the handle 18'.

As shown in FIG. 4, the gun brush 10 can also be used to clean the clip receptacle 12 of a rifle gun 14.

It will be understood that each of the elements described above, or two or more together, may also find a useful application in other types of constructions differing from the type described above.

While the invention has been illustrated and described as embodied in a gun brush, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. In combination a brush and a clip receptacle of a gun, the clip receptacle having a cross-sectional shape, comprising:

(a) a handle portion; and (b) a brush portion attached to said handle portion and having a cross sectional shape that matches the cross sectional shape of the clip receptacle of the gun so that said brush portion can easily enter the clip receptacle of the gun and readily clean the clip receptacle, said cross sectional shape of said brush portion having a rounded front and a flat back.

2. A brush as defined in claim 1; further comprising means for attaching said brush portion to and in alignment with said handle portion.

3. A brush as defined in claim 1, wherein said handle portion contains hand grips so that the user can achieve a better grip.

4. A brush as defined in claim 2; further comprising means for fixedly attaching said brush portion to said handle portion.

5. A brush as defined in claim 2; further comprising means for pivotally attaching said brush portion to said handle portion so that said brush portion can stay retracted in said handle during the retracted position and can pivot outward during the extended position.

* * * * *